US007828289B2

(12) United States Patent
Mumford

(10) Patent No.: US 7,828,289 B2
(45) Date of Patent: Nov. 9, 2010

(54) STACKER TRAY ASSEMBLY FOR A PHOTOCOPIER

(76) Inventor: Willard G. Mumford, 1025 N. Harrison St., Algonquin, IL (US) 60102

( * ) Notice: Subject to any disclaimer, the term of this patent is extended or adjusted under 35 U.S.C. 154(b) by 391 days.

(21) Appl. No.: 11/760,112

(22) Filed: Jun. 8, 2007

(65) Prior Publication Data

US 2008/0303205 A1 Dec. 11, 2008

(51) Int. Cl.
*B65H 31/00* (2006.01)

(52) U.S. Cl. ..... 271/207; 271/213; 271/224; 399/405

(58) Field of Classification Search ..... 271/207, 271/213, 224; 399/405, 406
See application file for complete search history.

(56) References Cited

U.S. PATENT DOCUMENTS

| | | | | |
|---|---|---|---|---|
| 5,454,553 | A * | 10/1995 | Firl et al. | 271/4.04 |
| 6,428,000 | B1 * | 8/2002 | Hara et al. | 271/223 |
| 6,601,842 | B2 * | 8/2003 | Kobayashi et al. | 271/3.14 |
| 6,641,318 | B2 * | 11/2003 | Yergenson | 400/625 |
| 7,237,969 | B2 * | 7/2007 | Bartman | 400/646 |

* cited by examiner

*Primary Examiner*—Stefanos Karmis
*Assistant Examiner*—Luis Gonzalez
(74) *Attorney, Agent, or Firm*—Mathew R.P. Perrone, Jr.; Brie A. Crawford

(57) ABSTRACT

A stacker tray assembly for a photocopier is easily mounted or removed from the copier, and permits facile handling of large copies. The stacker tray assembly for a photocopier for producing large copies has a main plate which has a copy side for insertion into the copier and a copy receiving end for receiving copies oppositely disposed therefrom. The stacker tray assembly also has a tilt plate at the copy receiving end to support the copies, as they exit the copier.

9 Claims, 6 Drawing Sheets

PAPER COPY FEEDING AND STACKING

REPLACING TONER CARTRIDGE

REPLENISHING PAPER

HINGE DETAIL

STACKER TRAY ASSEMBLY FOR A PHOTOCOPIER

This invention relates to a stacker tray assembly for a photocopier and more particularly to a stacker tray assembly for a photocopier, which renders photocopiers for large copies more efficient.

BACKGROUND OF THE INVENTION

Photocopiers are ubiquitous in many work places. They are multi-functional and an absolute necessity in the office of today. Such copiers are extremely well-developed, especially with regard to the making of copies having a size of eleven inches by seventeen inches or less. The making, collection, collating, organizing, or handling of those copies can be very efficient.

In the making of copies having a size larger than eleven inches by seventeen inches, many problems occur. Yet such copies are necessary for blueprints, surveys and the like. During the making of the copies, the required collection, collating, organizing, or handling of those copies is usually very inefficient. This is especially a problem when a large plurality of copies is required.

As that large plurality of copies is being made, each copy needs to be collected and handled efficiently. The speed of the copies coming off of the photocopier greatly interferes with such efficiency. A device to facilitate collection of those larger copies can greatly improve efficiency in handling of those copies.

Furthermore, there are a number of larger copy sizes need. If the device can be adjusted to handle the various larger sized copies, even greater efficiency is obtained for the stacker tray assembly. The more simple the adjustment, the better the stacker tray assembly will be.

Finally, when printing large orders of copies on large paper, the toner cartridge or paper roll may be consumed. It is inefficient to remove the stacker tray assembly, in order to replace the toner cartridge or the paper roll, and then remount the stacker tray assembly on the photocopier. Therefore, a stacker tray assembly which allows for the toner cartridge or the paper roll to be replaced without removing the stacker tray assembly from the photocopier would be a useful invention.

SUMMARY OF THE INVENTION

Among the many objectives of the present invention is the provision of a stacker tray assembly for a photocopier, which supports large copies.

Another objective of the present invention is the provision of a stacker tray assembly for a photocopier, which collects large copies.

Yet another objective of the present invention is the provision of a stacker tray assembly for a photocopier, which organizes large copies.

Still another objective of the present invention is the provision of a stacker tray assembly for a photocopier, which is adjustable.

Also an objective of the present invention is the provision of a stacker tray assembly for a photocopier, which is easily attached to the photocopier.

A further objective of the present invention is the provision of a stacker tray assembly for a photocopier, which is easily removed from the photocopier.

A still further objective of the present invention is the provision of a stacker tray assembly for a photocopier which allows for the toner cartridge to be changed while the stacker tray assembly is still mounted to the photocopier.

Moreover, an objective of the present invention is the provision of a stacker tray assembly for a photocopier which allows for the paper roll to be replaced while the stacker tray assembly is still mounted to the photocopier.

These and other objectives of the invention (which other objectives become clear by consideration of the specification, claims and drawings as a whole) are met by providing a stacker tray assembly for a photocopier, which is easily mounted or removed from the copier, and permits facile handling of large copies.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

The stacker tray assembly for a photocopier for producing large copies has a main plate which has a copier side for insertion into the copier and a copy receiving end for receiving copies oppositely disposed therefrom. The copier side includes mounting slots, rounded tabs, and securing wings to form a secure attachment for the stacker tray assembly as it fits into the copier.

The rounded edges of the copier side facilitate a free movement of the copy from the copier and aid a copy as it exits the copier. The stacker tray assembly also has a tilt plate at the copy receiving end to further support the copies, as they exit the copier and pass over the main plate to the tilt plate.

With the mounting slots and securing wings on the copier side, the stacker tray assembly fits easily into the copier. The slots and securing wings fit around features in the copy exit portion of the photocopier. Such a combination facilitates the mounting and removing of the stacker tray assembly.

At the copy receiving end of the stacker tray assembly, the tilt plate facilitates the copy collection. The tilt plate may be molded as a part of the main plate. However, greater flexibility is achieved when the tilt plate is connected to the main plate by the piano hinge.

On the main plate, adjacent to the tilt plate, is a pair of securing legs on opposing sides thereof. The pair of securing legs serves support pieces with the lower side supporting the stacker tray assembly on the copier and holding the tilt plate in a desired, preferably upright, position.

Figure 1:
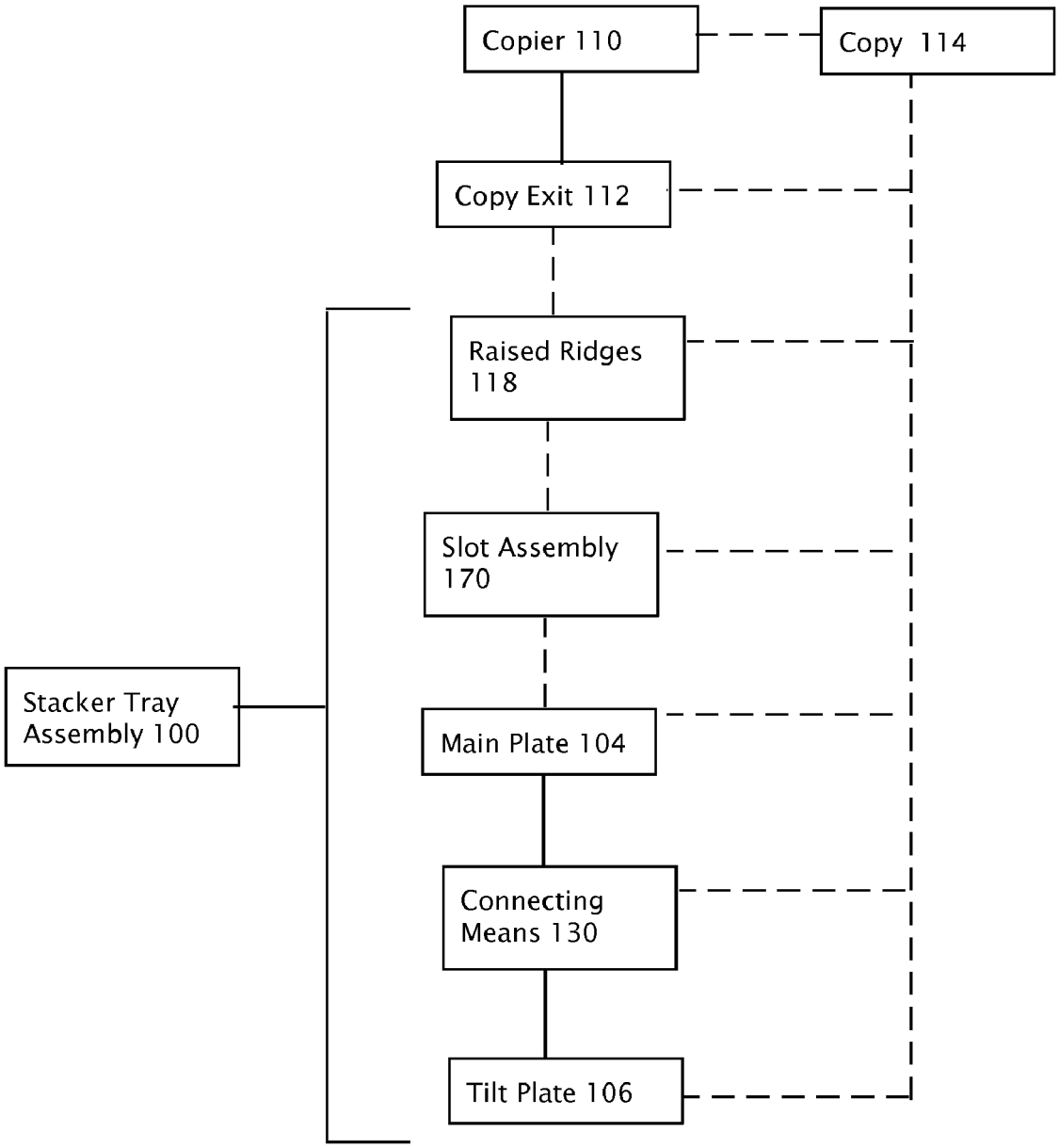
FIG. 1 depicts a block diagram of the stacker tray assembly 100 of this invention in combination with a photocopier 110.

Referring now to FIG. 1, stacker tray assembly 100 has a main plate 104 which is inserted into copier 110 at copy exit 112. As a result, main plate 104 and tilt plate 106 are exposed and usable for positioning and guiding at least one copy 114. The at least one copy 114 leaves copier 110 at copy exit 112, contacts main plate 104, and proceeds to tilt plate 106, potentially even hanging thereover, if copy 114 is long enough.

Figure 6:
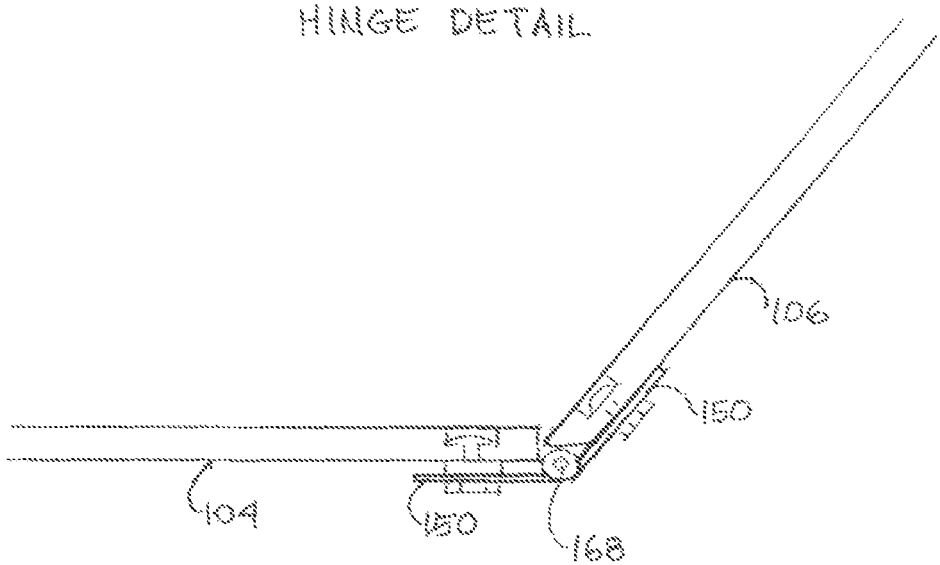
FIG. 6 depicts a side view of piano hinge 142.

Main plate 104 is connected to tilt plate 106 through connecting means 130. Connecting means 130 can be any suitable fastening means. Main plate 104 and tilt plate 106 may be molded as one unit. But, it is preferred that connecting means 130 is a piano hinge 142 (as shown in FIG. 6) to permit more flexibility for stacker tray assembly 100. Piano hinge 142 allows tilt plate 106 to be adjusted at a variety of angles relative to main plate 104 (as explained further in FIG. 6).

However, in an alternate embodiment, connecting means 130 is hingeless with a continuous mold of main plate 104 and tilt plate 106 (shown in FIG. 1). In this case, stacker tray assembly 100 is molded to allow a continuous piece with the main plate 104 extending into the tilt plate 106 with an upward slope for the tilt plate 106 at the end.

Figure 2:
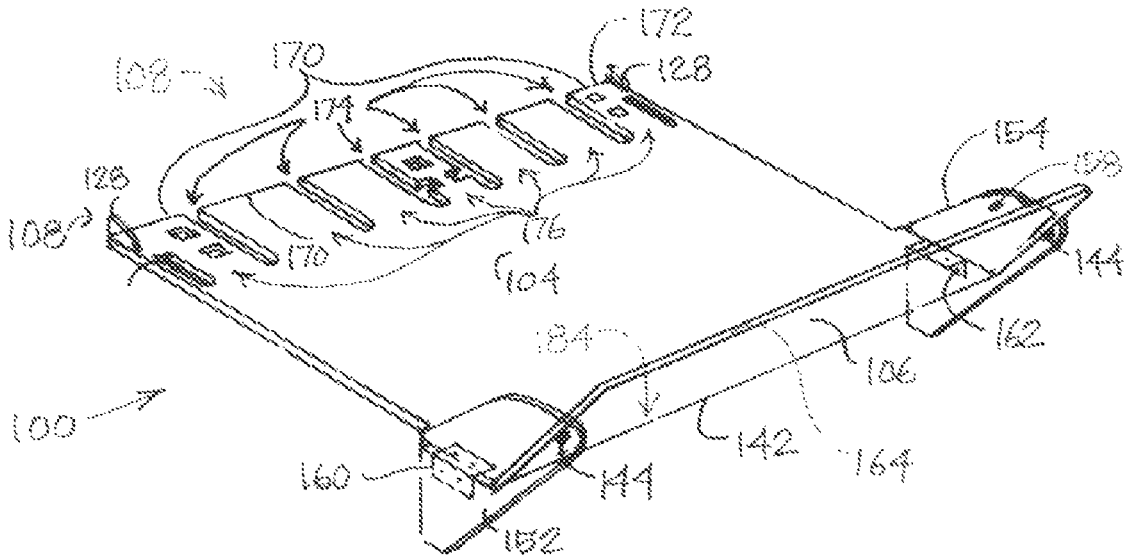
FIG. 2 depicts a perspective view of the stacker tray assembly 100.

Adding FIG. 2 to the consideration, the structure of stacker tray assembly 100 can clearly be seen. Stacker tray assembly 100 has main plate 104 which has a copier side or copier end 108 and a copy receiving end 164. Copier end 108 has an insertion edge 172 thereat, which inserts into copier 110 and copy receiving end 164 has a paper edge 184 which connects with tilt plate 106.

Insertion edge 172 is designed to fit into copier 110 at copy exit 112. On insertion edge 172 is slot assembly 170 which includes a plurality of slots 174 interspersed with a plurality of rounded tabs 176. The plurality of rounded tabs 176 are cylindrical or rounded in order to help guide and move copy 114 as it exits copier 110 at copy exit 112. If rounded tabs 176 do not exist, copies tend to catch on stacker tray assembly 100, and cause great trouble in the copy making process.

Within copier 110 at copy exit 112, are optionally a number of raised ridges 118 (FIG. 1). Each of the raised ridges 118 fits into one of the plurality of slots 174, as main plate 104 rests in copy exit 112, in order to secure stacker tray assembly 100 in copier 110.

Main plate 104 also has a pair of securing wings 128 oppositely disposed on each side of insertion edge 172. Securing wings 128 further establish a strong and stable connection between copier 110 and main plate 104. At copy receiving end 164 is paper edge 184 where main plate 104 connects to tilt plate 106. Tilt plate 106 is secured to main plate 104 through piano hinge 142.

On copy receiving end 164 is a first leg 152 and a second leg 154 which facilitate the mounting and positioning of main plate 104 onto copier 110. The first leg 152 and second leg 154 are continuously molded with main plate 104. First leg 152 and second leg 154 are also adjacent to the piano hinge 142 at oppositely disposed sides.

First leg 152 and second leg 154 are attached to main plate 104 through first bracket 160 and second bracket 162 respectively. First leg 152 and second leg 154 have locking pins 144. Tilt plate 106 can be secured at the desired angle relative to main plate 104 through its interaction with locking pins 144.

Tilt plate 106 is lifted beyond the desired angle. Then, locking pin 144 is placed perpendicular to main plate 104. As tilt plate 106 rotates relative to main plate 104 on piano hinge 142 or gravitates in a downward direction, locking pins 144 stop the movement and secure tilt plate 106 in the desired position.

Figure 3:
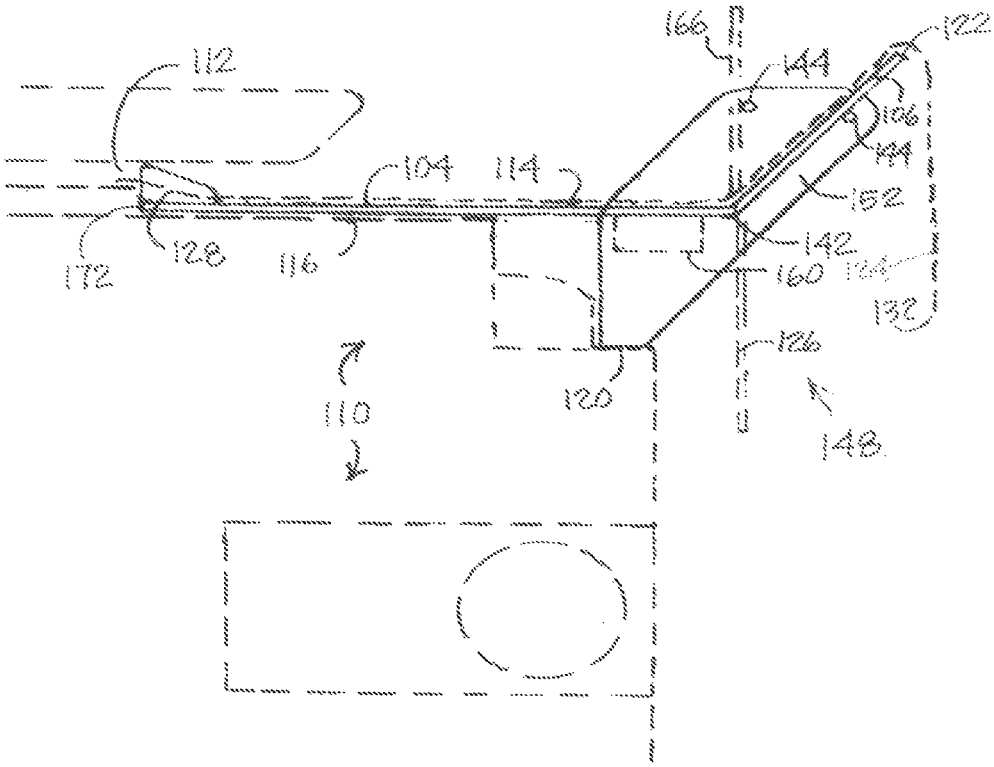
FIG. 3 depicts a side view of stacker tray assembly 100 in combination with photocopier 110.

Adding FIG. 3 to the consideration, the interaction of stacker tray assembly 100 and copier 110 can be clearly seen. Insertion edge 172 is inserted into copier 110 and main plate 104 rests on copy tray surface 116 as first leg 152 and second leg 154 (as shown in FIG. 2) support it on copy machine ledge 120 in the original position 148. Tilt plate 106 can be placed at a variety of angles relative to main plate 104 as can be seen from the range between raised position 166 and lowered position 126.

As a copy 114, proceeds from copier 110 from copy exit 112, to main plate 104 and then upwards on tilt plate 106, each copy 114 becomes easier to collect and prepare for distribution. If the at least one copy 114 is about 61 centimeters (24 inches) or less in length, it will exit copier 110 at copy exit 112 and rest in its entirety on main plate 104. If the at least one copy 114 is between about 61 and 82 centimeters (about 24 to 32 inches) in length, it will extend onto tilt plate 106 but will not extend over tilt plate edge 122. If the at least one copy 114 is between about 92 and 153 centimeters in length (about 36 to 60 inches), the leading edge 132 will extend onto and over tilt plate edge 122 dropping vertically downward until travel stops. The leading edge 132 will end in stop position 124.

Figure 4:
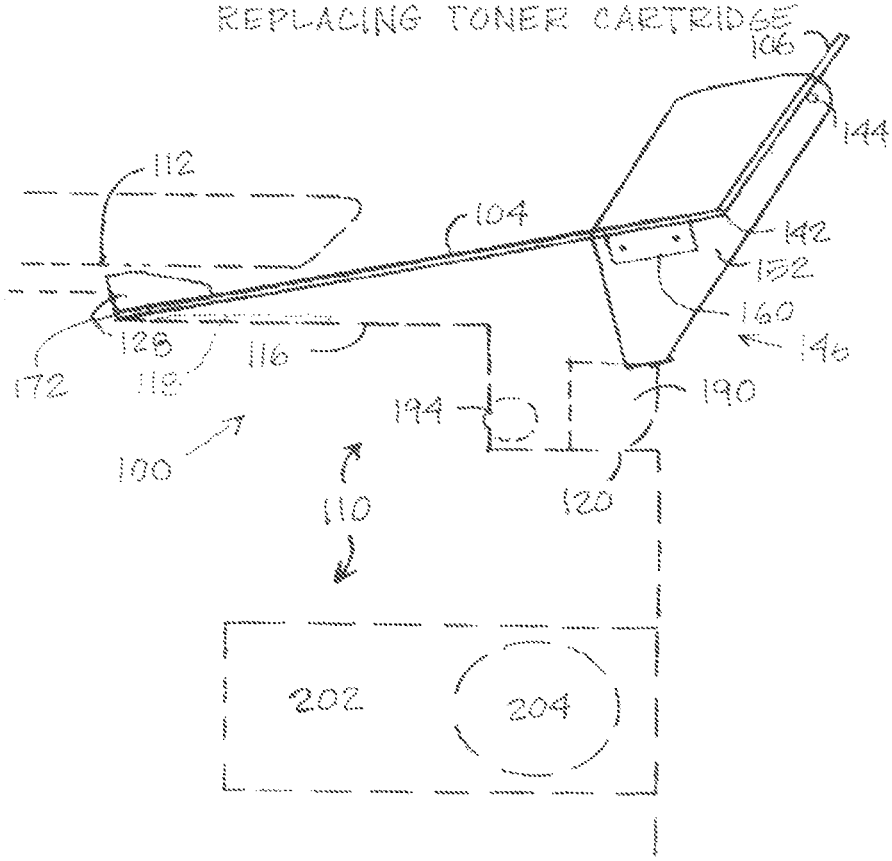
FIG. 4 depicts a side view of stacker tray assembly 100 in open position 146.

Adding FIG. 4 to the consideration, the flexibility of stacker tray assembly 100 can further be seen with regard to replacing toner cartridge 194. Toner cartridge 194 can be changed without the need to remove stacker tray assembly 100 from copier 110. Insertion edge 172 acts as a hinging mechanism in this stage. Stacker tray assembly 100 is lifted on insertion edge 172 as required to allow toner cover 190 to open. Customarily, stacker tray assembly 100 must be lifted about 10 centimeters (four inches) in order to allow toner cover 190 to open.

After toner cover 190 is opened, stacker tray assembly 100 is lowered about insertion edge 172. First leg 152 and second leg 154 rest on toner cover 190 and secure stacker tray assembly 100 in open position 146. This procedure frees the operator (not shown) from holding the stacker tray assembly 100 in open position 146 so that the operator is able to change the toner cartridge 194.

Once toner cartridge 194 has been changed, stacker tray assembly is lifted high enough about insertion edge 172 to allow toner cover 190 to close. Customarily, stacker tray assembly 100 must be lifted about 10 centimeters (four inches) in order to allow toner cover 190 to close. Once, toner cover 190 is closed, stacker tray assembly 100 is returned to its original position 148 (as shown in FIG. 3) where first leg 152 and second leg 154 rest on copy machine ledge 120. Then, copier 110 is reactivated.

Figure 5:
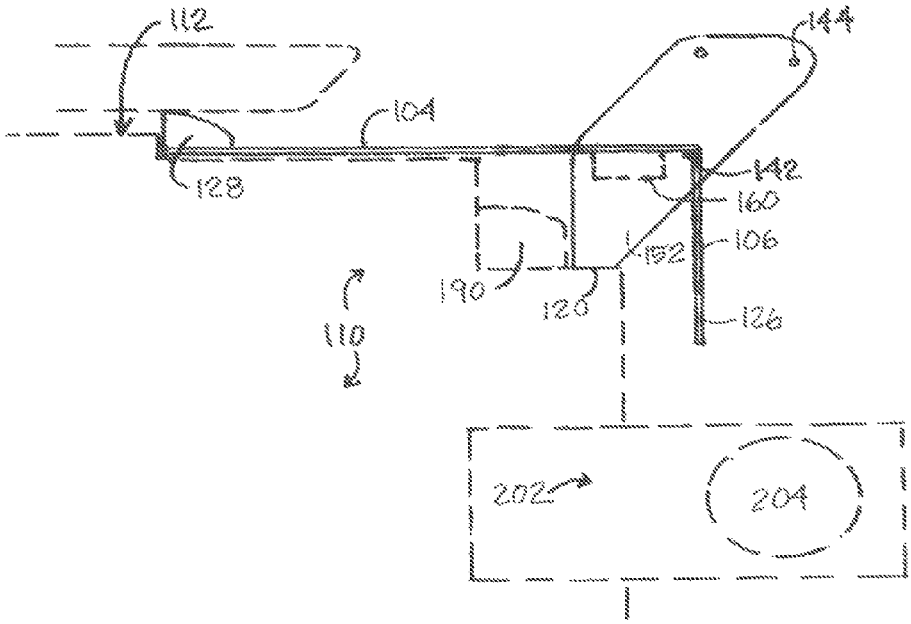
FIG. 5 depicts a side view of the stacker tray assembly 100 with tilt plate 106 in lowered position 126.

Adding FIG. 5 to the consideration, the flexibility of stacker tray assembly 100 can be clearly seen, with reference to changing paper. Tilt plate 106 is placed in lowered position 126 to allow unobstructed access to paper drawer 202. First leg 152 and second leg 154 are pushed outward from tilt plate 106 in order to allow tilt plate 106 to be released from locking pins 144 and move forward into lowered position 126. Paper drawer 202 is opened, paper roll 204 is replaced, and paper drawer 202 is closed. Then, tilt plate 106 can be repositioned in any desired position. Thus, paper roll 204 can be replaced without removing stacker tray assembly 100 from copier 110.

Adding FIG. 6 to the consideration, the piano hinge 142 cooperates with first bracket 160, and second bracket 162 to position tilt plate 106. Main plate 104 is connected to tilt plate 106 through piano hinge 142. Piano hinge 142 has a pair of hinge plates 150 with one hinge plate 150 connected to tilt plate 106 and the other connected to main plate 104. Hinge plates 150 are pivotally attached together through hinge pin 168.

Tilt plate 106 is preferably angled from five degrees to 85 degrees relative to the main plate 104. Tilt plate 106 is more preferably from ten degrees to 75 degrees relative to the main plate 104. Tilt plate 106 is most preferably from 15 degrees to 65 degrees relative to the main plate 104.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A stacker tray assembly for a photocopier to assist in the production of large copies comprising:

a) the stacker tray assembly having a main plate and a tilt plate;

b) a connecting means joining the main plate and the tilt plate;

c) the tilt plate being movable relative to the main plate;

d) the tilt plate being positionable relative to the main plate;

e) the tilt plate having an upward slope relative to the main plate;

f) the main plate having a copier side and a copy receiving end;

g) the copier side being insertable into the photocopier;

h) the copy receiving end receiving copies from the photocopier;

i) the copier side being oppositely disposed from the copy receiving end;

j) the tilt plate cooperating with the main plate to support the copies;

k) the copier side including a slot assembly of mounting slots and tabs for supporting the stacker tray assembly in the copier;

l) a positioning means to hold the tilt plate in a desired position relative to the main plate;

m) the hinge being a piano hinge;

n) the piano hinge permitting the tilt plate to be adjusted at a variety of angles relative to main plate;

o) the tilt plate having a variety of positions relative to main plate;

p) the slot assembly having rounded edges to facilitate passage of a copy from the copier to the stacker tray assembly;

q) the slot assembly facilitating the mounting of the stacker tray assembly on the copier;

r) the slot assembly providing for the stacker tray assembly on the copier;

s) the main plate having an insertion edge on the copier side;

t) a pair of securing wings being oppositely disposed on each side of the insertion edge;

u) the pair of securing wings adding to a strong and stable connection between the copier and main plate;

v) a paper edge on the main plate oppositely disposed from the copier side; and w) the tilt plate being secured to the main plate through the piano hinge at the paper edge.

2. The stacker tray assembly of claim 1 further comprising:

a) the copy receiving end having a first leg and a second leg at oppositely disposed sides thereof in order to facilitate the mounting and positioning of the main plate onto the copier;

b) the first leg and the second leg being continuously molded with the main plate and adjacent to the piano hinge; and c) the first leg and the second leg cooperating to position the tilt tray.

3. The stacker tray assembly of claim 2 further comprising:

a) the first leg having a first locking pin;

b) the second leg having a second locking pin;

c) the first leg and the second leg supporting the tilt plate at a desired angle relative to the main plate; and d) the tilt plate being angled from five degrees to 85 degrees relative to the main plate.

4. In a copier adapted to make large copies, the improvement comprising:

a) a stacker tray assembly for the copier to assist in the production of large copies;

b) the stacker tray assembly having a main plate and a tilt plate;

c) a connecting means joining the main plate and the tilt plate;

d) the tilt plate being movable relative to the main plate;

e) the tilt plate being positionable relative to the main plate;

f) the main plate having a copier side and a copy receiving end;

g) the copier side being insertable into the photocopier;

h) the copy receiving end receiving copies from the photocopier;

i) the copier side being oppositely disposed from the copy receiving end;

j) the tilt plate cooperating with the main plate to support the copies;

k) the copier side including a slot assembly of mounting slots and tabs for supporting the stacker tray assembly in the copier;

l) the connecting means being a hinge joining the tilt plate to the main plate;

m) a positioning means to hold the tilt plate in a desired position relative to the main plate;

n) the hinge being a piano hinge;

o) the piano hinge permitting the tilt plate to be adjusted at a variety of angles relative to main plate;

o) the tilt plate having a variety of positions relative to main plate;

p) the slot assembly having rounded edges to facilitate passage of a copy from the copier to the stacker tray assembly;

q) the slot assembly facilitating the mounting of the stacker tray assembly on the copier;

r) the slot assembly providing for the stacker tray assembly on the copier;

s) the main plate having an insertion edge on the copier side;

t) a pair of securing wings being oppositely disposed on each side of the insertion edge;

u) the pair of securing wings adding to a strong and static connection between the copier and main plate;

v) a paper edge on the main plate oppositely disposed from the copier side; and w) the tilt plate being secured to the main plate through the piano hinge at the paper edge.

5. The copier of claim 4 further comprising:

a) the copy receiving end having a first leg and a second leg at oppositely disposed sides thereof in order to facilitate the mounting and positioning of the main plate onto the copier;

h) the first leg and the second leg being continuously molded with the main plate and adjacent to the piano hinge; and c) the first leg and the second leg cooperating to position the tilt tray.

6. The copier of claim 5 further comprising:

a) the first leg having a first locking pin;

b) the second leg having a second locking pin; and c) the first leg and the second leg supporting the tilt plate at a desired angle relative to the main plate.

7. A method of collecting large copies from a copier or a photocopier comprising:

a) providing a stacker tray assembly for the copier to assist in the production of large copies;

the stacker tray assembly having a main plate and a tilt plate;

a connecting means joining the main plate and the tilt plate;

the tilt plate being movable relative to the main plate;

the tilt plate being positionable relative to the main plate;

the main plate having a copier side and a copy receiving end;

the copier side being insertable into the photocopier;

the copy receiving end receiving copies from the photocopier;

the copier side being oppositely disposed from the copy receiving end;

the tilt plate cooperating with the main plate to support the copies;

the copier side including a slot assembly of mounting slots; tabs for supporting the stacker tray assembly in the copier;

a positioning means to hold the tilt plate in a desired position relative to the main plate:

positioning the tilt plate at an angle of from 15 degrees to 65 degrees relative to the main plate;

providing a series of raised ridges within copier at a copy exit;

positioning the mounting slots around a set of raised ridges, with each member of the mounting slots a member of the set of raised ridges;

lifting the stacker tray assembly when a change of paper or toner for the copier is desired without removing the stacker tray assembly from the copier;

lowering the stacker tray assembly when a change of paper or toner for the copier is complete without removing the stacker tray assembly from the copier;

providing the hinge as a piano hinge;

using the piano hinge to permit the tilt plate to be adjusted at a variety of angles relative to main plate; and supporting the tilt plate at a variety of positions relative to main plate.

8. The method of claim 7 further comprising:

a) providing the slot assembly with rounded edges to facilitate passage or a copy from the copier to the stacker tray assembly;

b) providing the main plate with an insertion edge on the copier side;

c) providing a pair of oppositely disposed securing wings on each side of the insertion edge;

d) providing the copy receiving end with a first leg and a second leg at oppositely disposed, sides thereof in order to facilitate the mounting and positioning of the main plate onto the copier; and e) having the first leg and the second leg continuously molded with the main plate and adjacent to the piano hinge.

9. The method of claim 8 further comprising:

a) the first leg having a first locking pin;

b) the second leg having a second locking pin; and c) the first leg and the second leg supporting the tilt plate at a desired angle relative to the main plate.

* * * * *